US007797801B2

(12) United States Patent
Takahashi

(10) Patent No.: US 7,797,801 B2
(45) Date of Patent: Sep. 21, 2010

(54) BUCKLE FOR BAND AND OBJECT WEARING DEVICE USING THE BUCKLE

(75) Inventor: Toshihiro Takahashi, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 221 days.

(21) Appl. No.: 12/186,028

(22) Filed: Aug. 5, 2008

(65) Prior Publication Data

US 2009/0049667 A1 Feb. 26, 2009

(30) Foreign Application Priority Data

Aug. 20, 2007 (JP) ..... 2007-214166

(51) Int. Cl.
*A44C 5/24* (2006.01)

(52) U.S. Cl. ..... 24/265 WS; 24/68 CT

(58) Field of Classification Search ..... 24/265 WS, 24/68 CT, 68 E, 905, 906
See application file for complete search history.

(56) References Cited

U.S. PATENT DOCUMENTS 2,491,977 A * 12/1949 Heller ..... 24/71 J
5,787,554 A * 8/1998 Hashimoto ..... 24/68 J
6,944,916 B2 * 9/2005 Kawagoe ..... 24/71 J

FOREIGN PATENT DOCUMENTS

JP 2001-292815 A 10/2001

* cited by examiner

*Primary Examiner*—Victor Batson
*Assistant Examiner*—Michael Lee
(74) *Attorney, Agent, or Firm*—Frishauf, Holtz, Goodman & Chick, P.C.

(57) ABSTRACT

A buckle for a pair of band sections connected to an object at a pair of opposite positions for wearing the object on a user's body includes a frame connected to one band section, a length adjustment chain connected to the other band, a chain folding-back shaft for folding back the chain, and a folding-back shaft position adjuster for moving the position of the folding-back shaft adjustably. When the position of the shaft is changed in the length direction of the frame, the position where the chain is folded back by the shaft changes and a distance between both the band sections is adjusted.

10 Claims, 17 Drawing Sheets

BUCKLE FOR BAND AND OBJECT WEARING DEVICE USING THE BUCKLE

CROSS-REFERENCE TO RELATED APPLICATIONS

This application is based upon and claims the benefit of priority from prior Japanese Patent Application No. 2007-214166, filed Aug. 20, 2007, the entire contents of which are incorporated herein by reference.

BACKGROUND OF THE INVENTION

1. Field of the Invention

The present invention relates to buckles for a band and devices using such buckle to be worn on a user's body.

2. Description of the Related Art

Divers generally wear a wristwatch on his or her wrist depending on himself or herself or on the surrounding circumstances. The diver may or may not put on a wetsuit. Therefore, the diver's band buckle and the device to be worn on an a part of his or her body are required to have the following conditions:

(1) The length of the wristband is capable of being largely, easily, rapidly and appropriately adjusted depending on the diameter of a part of the driver's body on which the wristwatch or device is worn:

(2) The number of parts of the buckle and device protruding outward is small and the buckle and device are difficult to catch objects present therearound; and (3) The buckle and device are not easily disengaged from the part of the diver's body, for example, due to shocks.

In order to meet these requirements, the applicants have proposed a band buckle for a diver as disclosed in Japanese Published Unexamined Patent Application 2001-292815. This buckle includes a slider connected pivotally at one end to one band, a bottom plate connected pivotally at one end to the other end of the slider so that the same is extendable therefrom, an intermediate plate pivoted at one end to the other end of the bottom plate so as to be foldable over the bottom plate, an upper cover pivoted at one end to the other end of the intermediate plate so as to be folded over the intermediate plate and pivoted at the other end to the other band, a safety cover turned over the upper cover of the folded buckle to prevent the turning of the upper cover, a latch mechanism which is operated by the opening of the safety cover, thereby allowing the slider fixed so far to the bottom plate to extend/retract freely, and a fixing mechanism which fixes the upper cover and the intermediate plate in a folded state on the intermediate plate.

The latch mechanism of this buckle comprises a pair of opposite latch pawls attached movable on a shaft and engaging a pair of parallel serrations, respectively, formed on the slider to stop its extension, a coil spring provided between the pair of latch pawls for forcing the respective latch pawls against the respective serrations, and a cam pivoted to the shaft so as not to move axially for pushing the respective latch pawls at their pressure reception ends to move the latch pawls inward against the resiliency of the coil spring. When the safety cover is turned and then opened so as to be upstanding, the cam is turned, thereby disengaging the pair of latch pawls from the pair of serrations.

The fixing mechanism comprises a T-shaped protrusion provided on the bottom plate, and a pair of hook-like buttons provided within a sleeve of the upper cover and biased by fixing springs so as to be extensible outward through both sides of the upper cover, thereby holding the T-shaped protrusion between ends thereof with lower inclined surfaces thereof. When the pair of hook-shaped buttons are compressed inward by fingers, the holding ends of the pair of hook-like buttons are opened, thereby releasing the T-shaped protrusion.

The diver's band buckle is very easy to handle because the length of the band is greatly changed by the slider and only turning and opening the safety cover is required to adjust the band length. A folded state of an articulated structure composed of the intermediate and bottom plates and the upper cover is doubly ensured by the fixing mechanism and the safety cover. Thus, the wristwatch worn by the band with the buckle on the user's wrist does not easily come off even by shocks. In addition, the buckle has few outward protruding parts such as catch peripheral objects undesirably. Thus, the buckle satisfies all the above-mentioned requirements.

However, the latch mechanism of this buckle is made of many parts including the cam, coil spring and pair of latch pawls, thereby making the structure complicated and expensive.

BRIEF SUMMARY OF THE INVENTION

It is an object of the present invention to provide a buckle capable of easily, rapidly and surely adjusting the length of a band attached to the buckle and composed of a reduced member of parts, thereby reducing the cost rationally, and a device using the buckle.

In one aspect, the present invention provides a buckle for a pair of band sections connected at one end to an object at a pair of opposite positions for wearing the object on a user's body, the buckle comprising:

a frame having a length connected at one end to one of the pair of band sections;

a length adjustment chain connected at one end to the other end of the frame and at the other end to the other end of the other band;

a chain folding-back shaft movable within the frame in its length direction for folding back the length adjustment chain within the frame in its length direction so as to extend outward from the other end of the frame; and a folding-back shaft position adjuster connected to the folding-back shaft so as to be movable within the frame in the length direction of the frame for adjusting the position of the folding-back shaft within the frame.

According to the inventive buckle, the folding-back shaft is moved in the length direction of the frame by the folding-back shaft adjuster. Thus, the overall band length is adjusted easily, rapidly and securely. In addition, the number of parts of the buckle is small. Thus, the cost is reduced reasonably.

In another aspect, the present invention provides a device to be worn on a user's body, comprising:

an object;

a pair of band sections connected at one end to the object at a pair of opposite positions for wearing the object on a user's body; and a buckle for connecting the other ends of the pair of bands, the buckle comprising:

a frame having a length connected at one end to one of the pair of band sections;

a length adjustment chain connected at one end to the other end of the frame and at the other end to the other end of the other band;

a chain folding-hack shaft movable within the frame in its length direction for folding back the length adjustment chain within the frame in its length direction so as to extend outward from the other end of the frame; and a folding-back shaft position adjuster connected to the folding-back shaft so as to be movable within the frame in the length direction of the frame for adjusting the position of the folding-back shaft within the frame in the length direction of the frame.

According to this invention, similar advantages as described for the first-mentioned invention are produced.

BRIEF DESCRIPTION OF THE SEVERAL VIEWS OF THE DRAWINGS

The accompanying drawings, which are incorporated in and constitute a part of the specification, illustrate embodiments of the present invention and, together with the general description given above and the detailed description of the embodiments given below, serve to explain the principles of the present invention, in which.

DETAILED DESCRIPTION OF THE INVENTION

Figure 1:
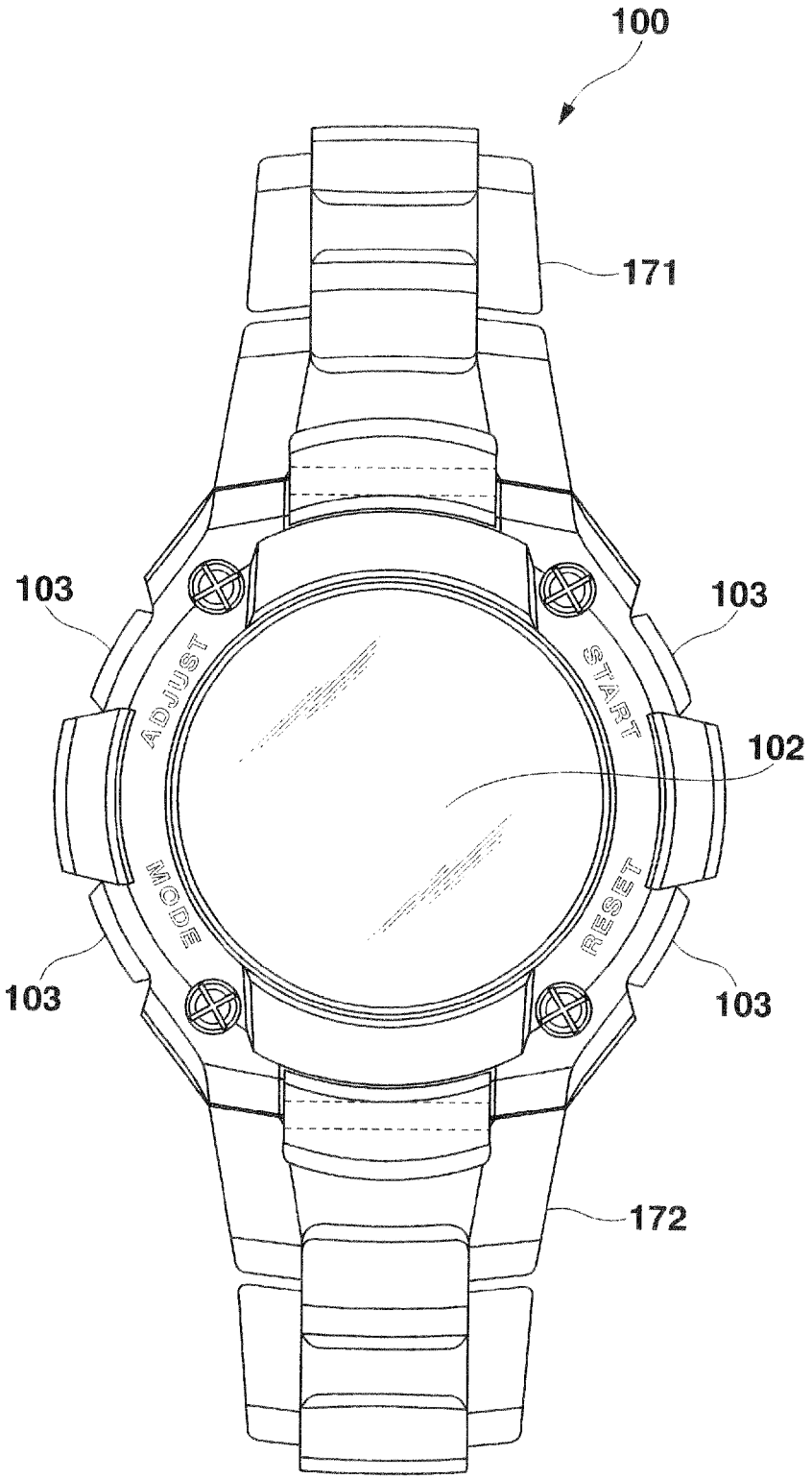
FIG. 1 is a plan view of a wristwatch according to an embodiment of the present invention.
Figure 2:
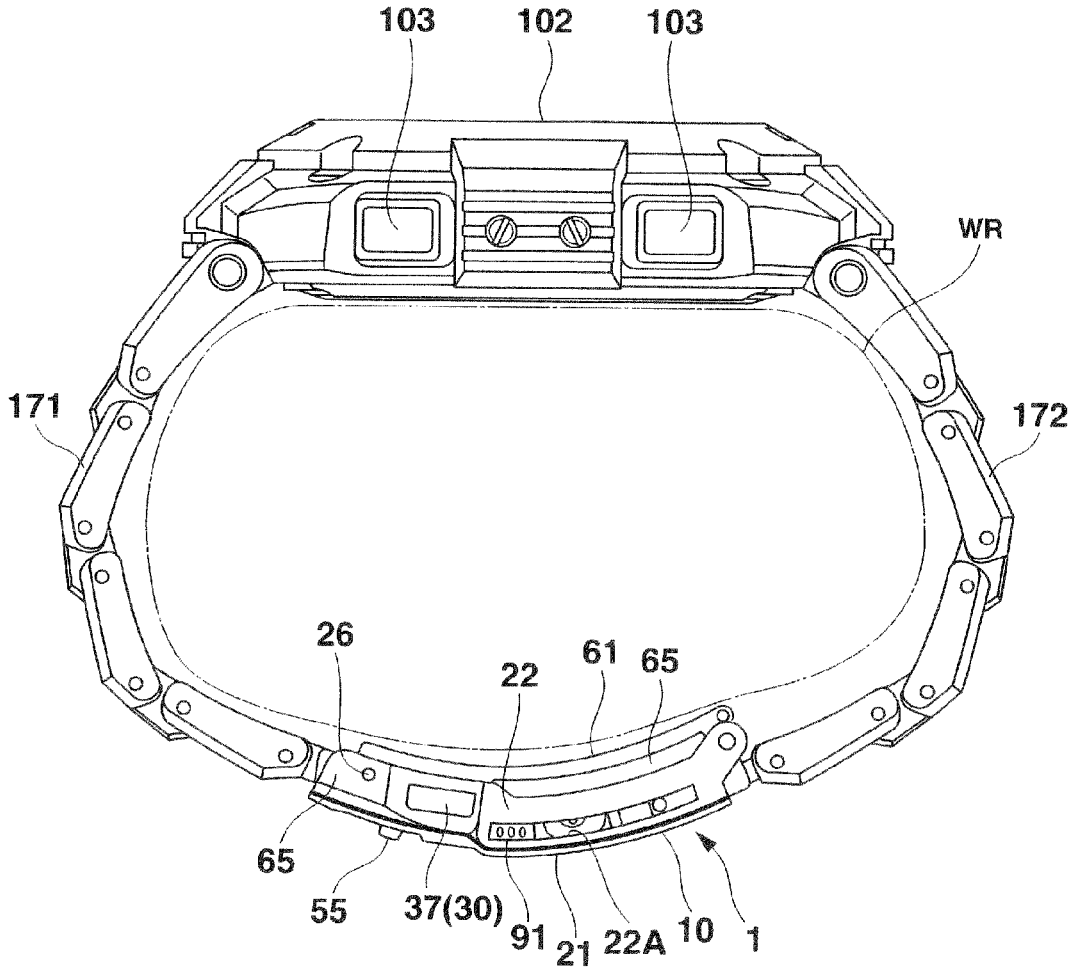
FIG. 2 is a side view of the wristwatch of FIG. 1.
Figure 3:
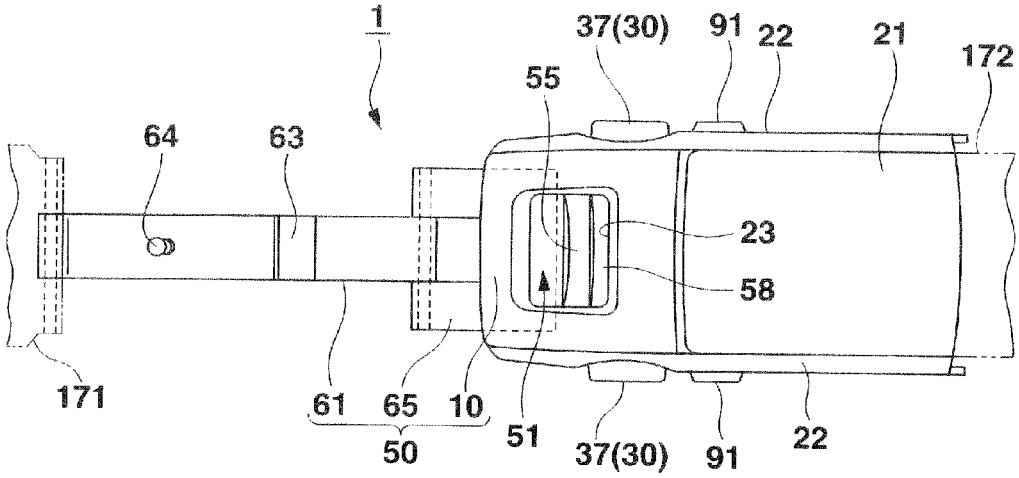
FIG. 3 is a plan view of a buckle for a wristband in one embodiment.
Figure 4:
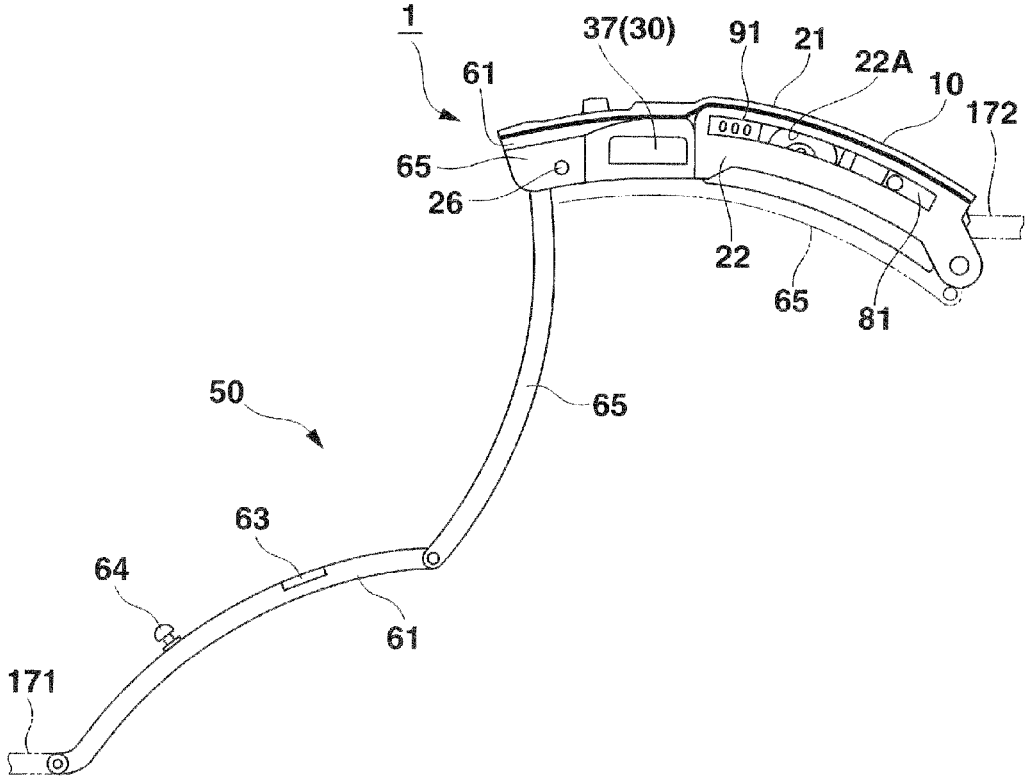
FIG. 4 is a side view of the buckle of FIG. 3.
Figure 5:
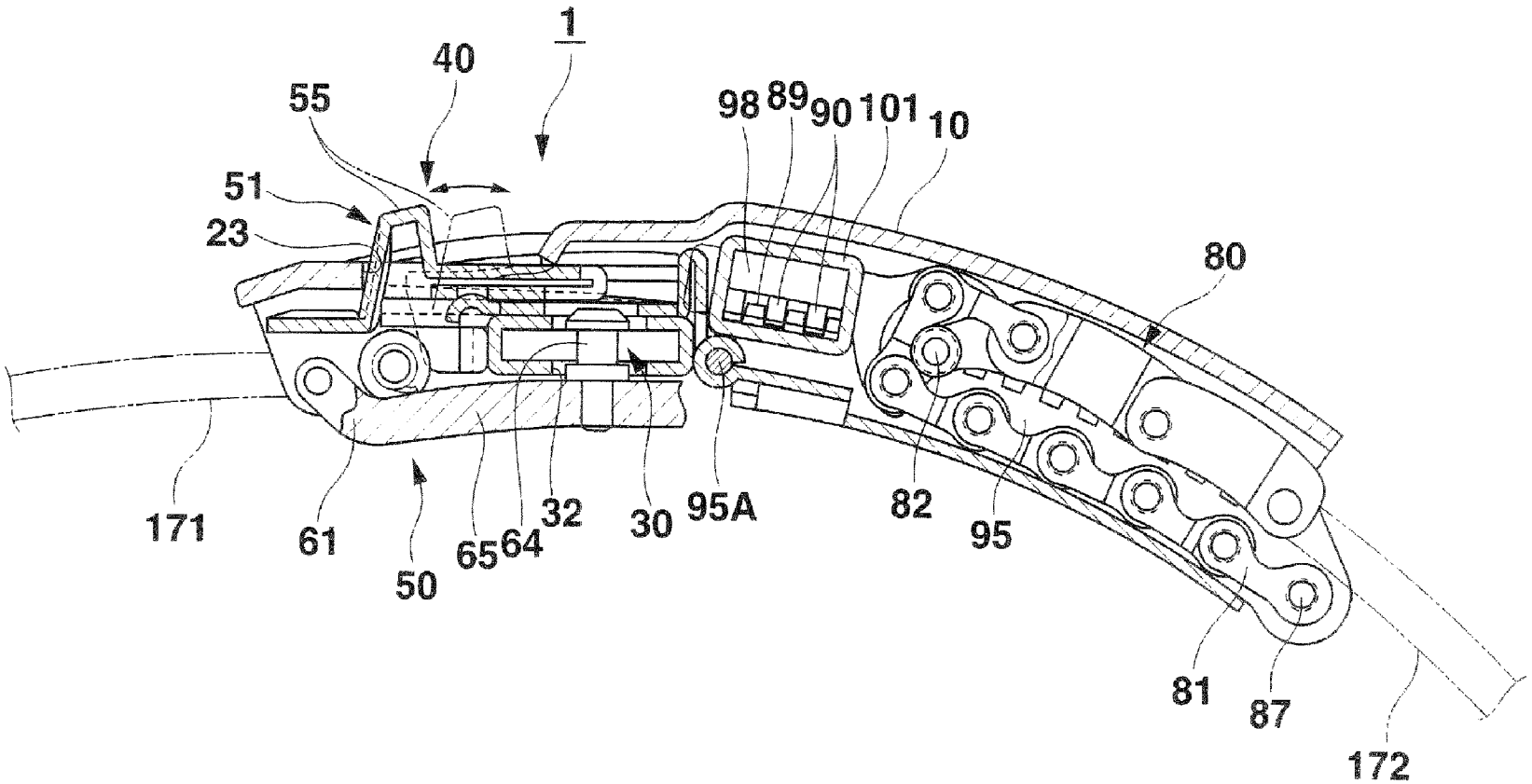
FIG. 5 is a cross-sectional view of the band buckle when folded.

A buckle for a wristwatch band and a device which is worn on a user's body and using the buckle according to one embodiment of the present invention will be described with reference to FIGS. 1-19B. FIG. 1 is a plan view of a wristwatch in an embodiment of the present invention. FIG. 2 is a side view of the wristwatch of FIG. 1. FIG. 3 is a plan view of a buckle for a wristband in one embodiment. FIG. 4 is a side view of the buckle of FIG. 3. FIG. 5 is a cross-sectional view of the buckle when folded.

The wristwatch 100 of the embodiment comprises a case 101, a display 102 provided on top of the case 101, a plurality of switches 103 provided on a side of the case 101, and a pair of band sections 171 and 172 connected at one end to the case 101 at opposite positions on its side.

The pair of band sections 171 and 172 has a buckle 1 which is used to tighten or loosen the pair of band sections 171 and 172 around the user's wrist, like a band buckle for a general wristwatch. As shown in FIGS. 3 and 4, the buckle 1 has an upper cover 10 including a frame and a folding band section 50 composed of an intermediate plate 65 and a bottom plate 61. The upper cover 10 is connected at one end to the band section 171 through the folding band section 50. The upper cover 10 is also connected at the other end to the other band section 172 through a length adjuster 80. More particularly, the bottom plate 61 is pivoted at a left end to the band section 171 and at a right end to a left end of the intermediate plate 65. The intermediate plate 65 is pivoted at a right end to a left end of the upper cover 10. The upper cover 10 is pivoted at a right end to the band 172 through the length adjuster 80.

Figure 7:
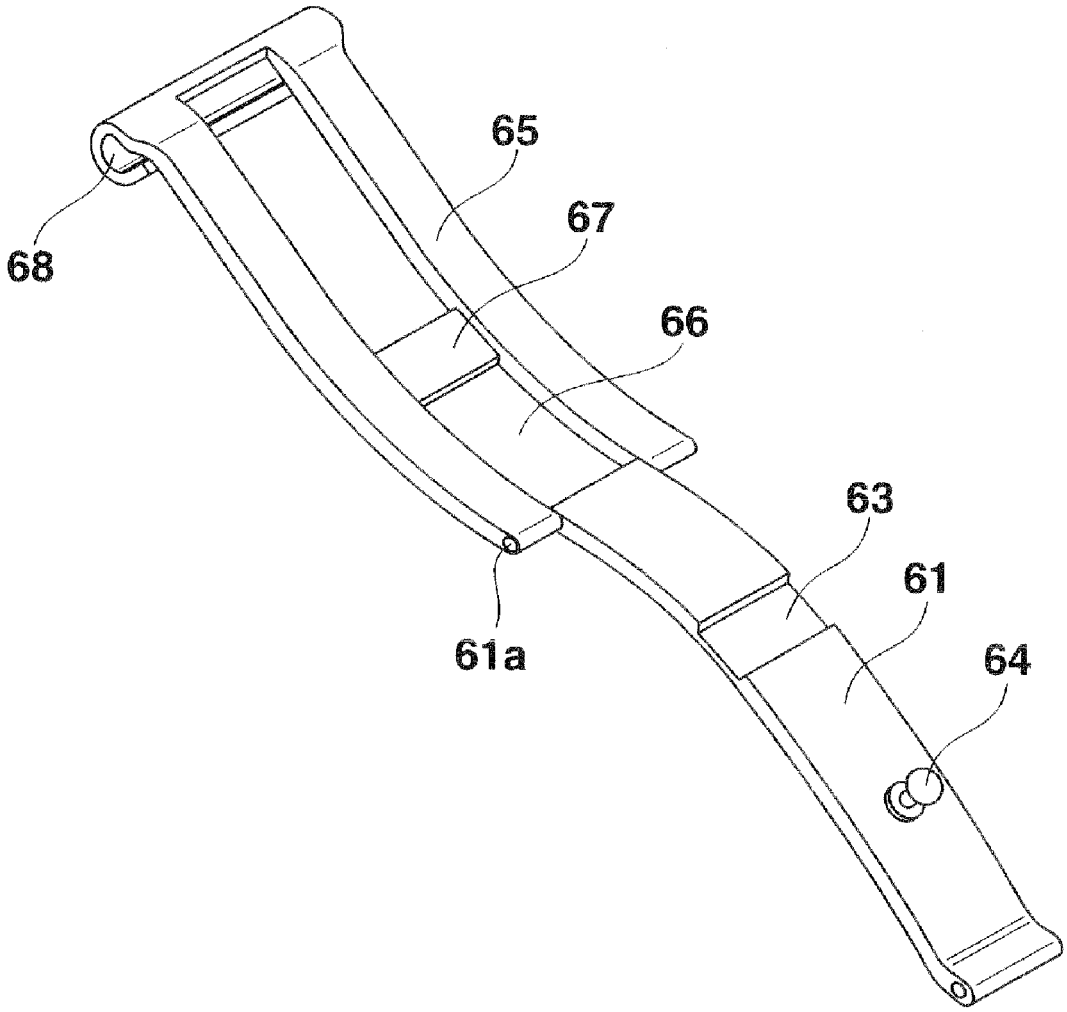
FIG. 7 is a perspective view of a folding band section.
Figure 8A:
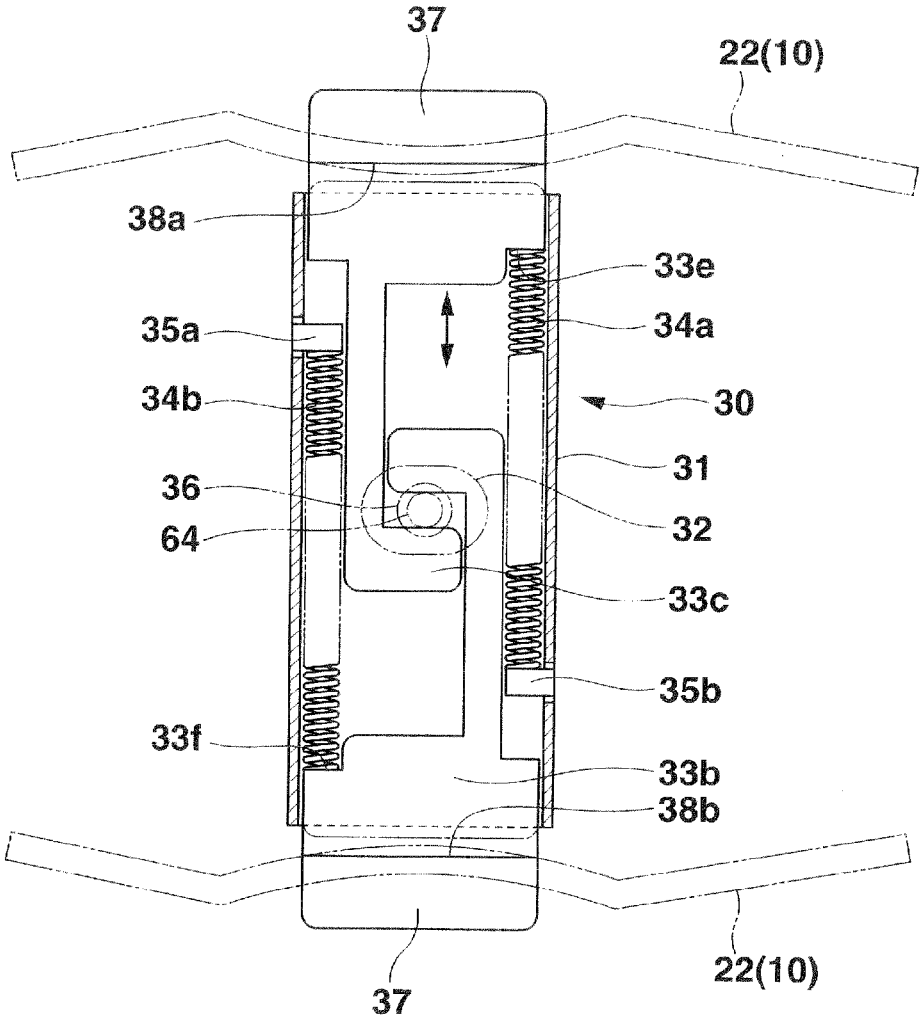
FIGS. 8A and 8B are a cross-sectional view and a side view, respectively, of a disengagement mechanism.
Figure 8B:
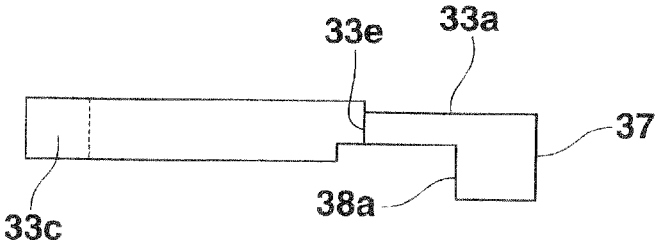
Figure 9A:
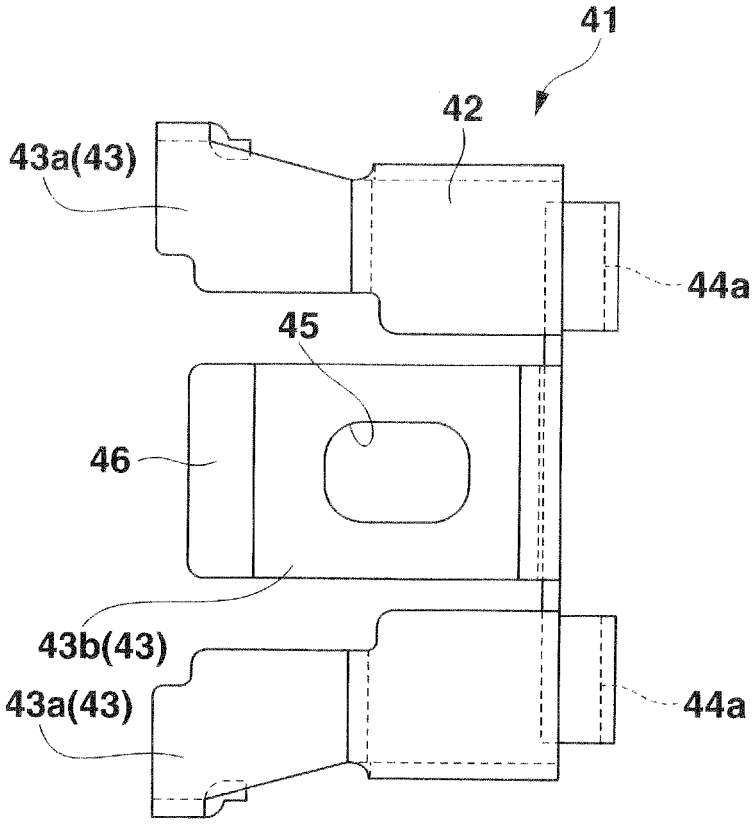
FIGS. 9A and 9B are a plan view and a side view, respectively, of a lock mechanism.
Figure 9B:
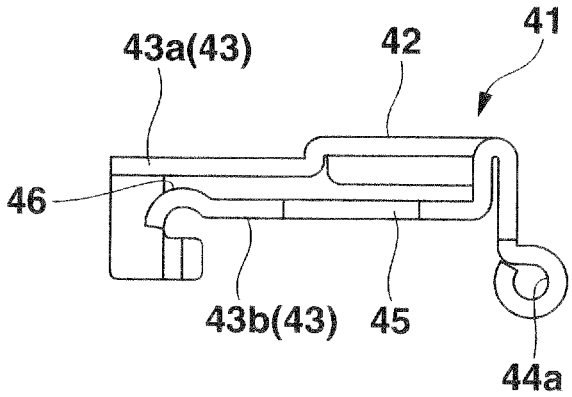

As shown in FIG. 7, the bottom plate 61 is in the form of a strip sized so as to fit into an elongated recess 66 extending axially in the intermediate plate 65. The bottom plate 61 has a recess 63 thereon near a midpoint thereof. A protrusion 64 is provided in the form of a nail half driven into the bottom plate 61 near its right end and engageable in a hole 32 provided in a disengagement mechanism (which will be described later) (FIGS. 8A and 8B). The protrusion 64 is used to maintain the upper cover 10, the intermediate plate 65 and the bottom plate 61 superimposed one on another as required.

As shown in FIG. 7, the intermediate plate 65 has a left end bent so as to form a hinge pin hole 68. A rectangular convexity 67 is provided so as to fit into the recess 63 provided in the bottom plate 61. The bottom plate 61 is turned around the pivot 61*a* to fit tightly into the elongated recess 66, thereby becoming a single plate to maintain the intermediate and bottom plates 65 and 61 in a stabilized tightly fitted state. The pivoted bottom and intermediate plate 61 and 65 are gently curved so as to fit to the outer periphery of the user's wrist when folded, improving a feeling of wearing the wristwatch 100 on the user's wrist.

Figure 6:
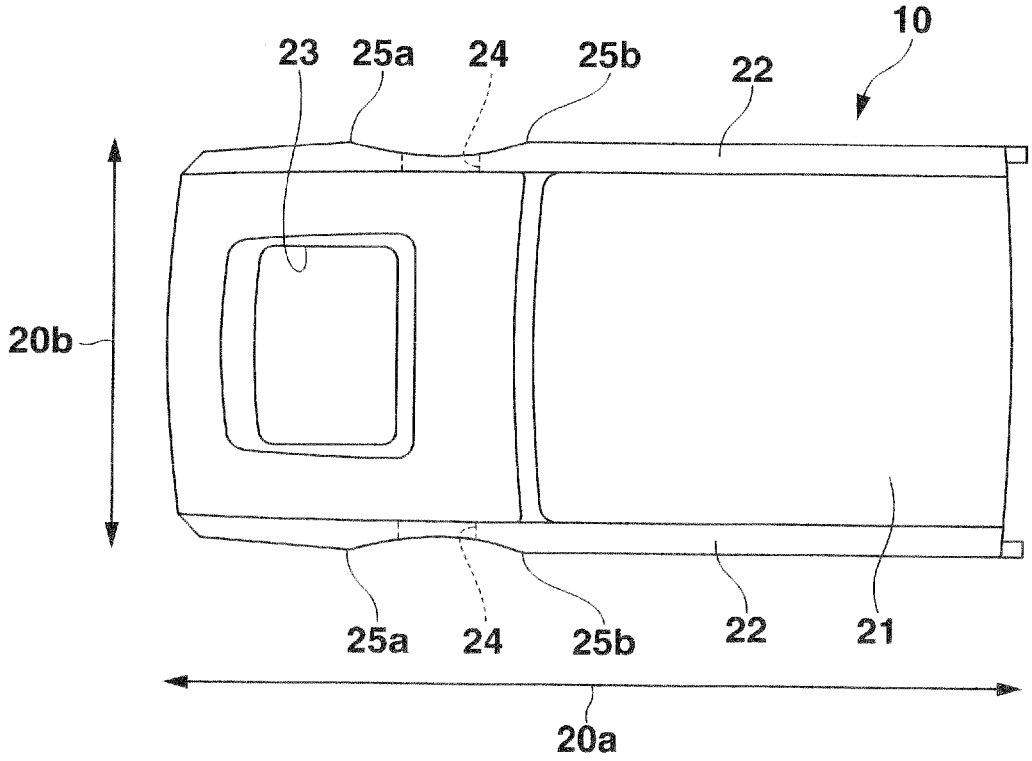
FIG. 6 is a plan view of an upper cover of the buckle.

The upper cover 10 contains a disengagement mechanism 30, the lock mechanism 40 and a band length adjuster 80 (see FIG. 5). As shown in FIGS. 5 and 6, the upper cover 10 forms the exterior of the buckle and is in substantially the form of a rectangular parallelepiped composed of a top 21 and right and left sides 22. The upper cover 10 is gently accurate-convex in longitudinal and width directions 20*a* and 20*b*. The top 21 has a rectangular opening 23 provided therein near the left end thereof. Both sides 22 of the upper cover 10 have rectangular openings 24 each provided in a cavity with a gently curved inner surface near the left end thereof and delimited by right and left edges 25*a* and 25*b* (FIG. 6) so as to improve the user's feeling that the user's thumb and first finger are fitted into the cavity to catch one of a pair of operation members 37 which will be described later in greater detail.

Figure 10A:
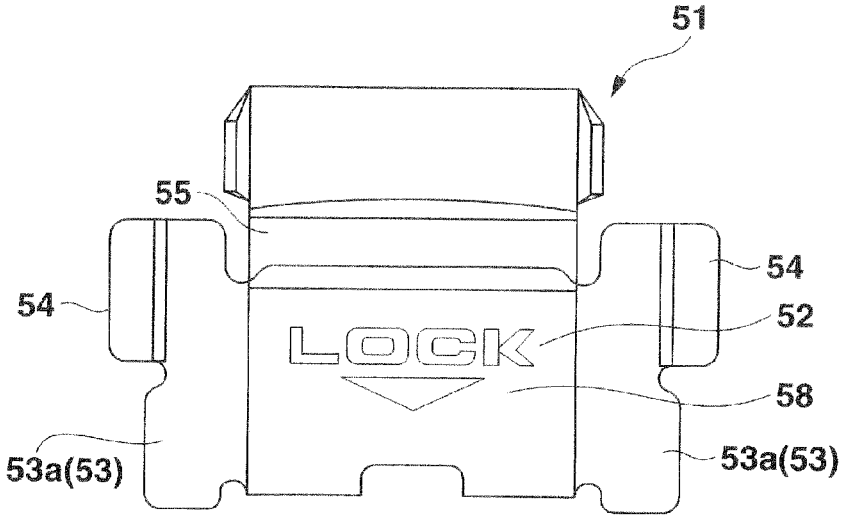
FIGS. 10A, 10B and 10C are a plan view, a cross-sectional view and a bottom view, respectively, of a plate member.
Figure 10B:
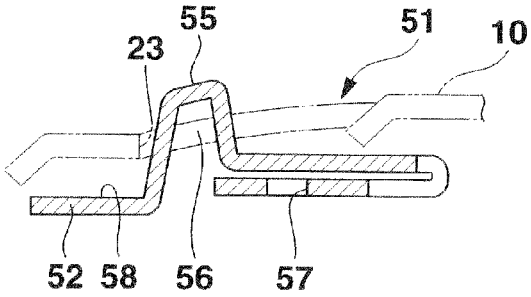

As shown in FIGS. 10A and 10B, a handle 55 of a plate member 51 protrudes upward through the opening 23 in the top 21 such that a visual section "LOCK" 58 formed on a plate member 51, which will be described later, can be viewed from outside. The peripheral edge area around the opening 23 is inclined toward the center of the same so as to allow the user to catch the handle 55 easily. The openings 24 on the sides 22 of the upper cover 10 are sized so as to allow the operation members 37, respectively, of the disengagement mechanism 30 to be received therethough. The peripheral area of each opening 24 is gently concaved toward the center of that opening such that the user can easily catch a related operation member 37, extending outward through a corresponding one of the openings 24, with the user's thumb and forefinger with a feeling that the user's fingers being appropriately fitted into the opening.

Both the sides of the upper cover 10 of FIG. 4 each have a hinge hole 26 on the left side of the opening 24 for hinge connection to the right end of the intermediate plate 65. The upper cover 10 can employ one of various shapes depending on a design of the buckle but not limited to that of the buckle of this embodiment.

As shown in FIG. 8A, the disengagement mechanism 30 has a hole 32 in the center of a cover 31 into which the protrusion 64 of the bottom plate 61 (FIGS. 4 and 7) fits. A pair of key-shaped guides 33*a* and 33*b* are disposed symmetrically around the hole 32 within the cover 31 so as to hold the hole 32 between feet 33*c* and 33*d* of the pair of guides 33*a* and 33*b*. The feet 33*c* and 33*d* also cooperate to form a hole 36 therebetween to receive the protrusion 64. Further, a pair of compression springs 34*a* and 34*b* is provided along the respective insides of the cover 31.

The cover 31 has a pair of stops 35*a* and 35*b* which abut on respective related ends of the pair of compression springs 34*a* and 34*b* the other ends of which abut on engaged side steps 33*e* and 33*f* provided on the pair of guides 33*a* and 33*b* so as to bias these guides outward from each other along the length of the cover 31. Thus, the hole 36 is decreased in size compared to the minimum diameter of the protrusion 64, thereby holding the protrusion 64 appropriately.

As shown in FIG. 8A, a pair of operation members 37 are provided so as to extend outside the pair of guides 33*a* and 33*b* to allow the respective guides to be pushed longitudinally inward from each other within the cover 31. Thus, when the pair of operation members 37 are pushed inward longitudinally toward each other within the cover 31 against the resiliency of the pair of springs 34*a* and 34*b*, the pair of feet 33*c* and 33*d* of the guides 33*a* and 33*b* are moved away from each other so as to increase the diameter of the hole 36, thereby releasing the protrusion 64 from the disengagement mechanism 30.

As shown in FIG. 8B, the pair of operation members 37 extend outward from each other through the openings 22 on the sides of the upper cover 10 and have a pair of inner restricting surfaces 38*a* and 38*b* which abut on a pair of stops 54 (FIG. 10A) of the lock mechanism 40 for stopping forward movement of the pair of guides 33*a* and 33*b*.

Referring to FIGS. 9A, 9B-11, the lock mechanism 40 comprises a lock mechanism body 41 attached to the back of the upper cover 10 and a plate member 51 attached movably to the lock mechanism body 41 (FIGS. 10A and 10B) to lock the disengagement mechanism 30 to disengage the protrusion 64 from the hole 32. The lock mechanism body 41 has a pair of upper cover contact parts 42 which are in close contact with the back of the upper cover 10 and a slide part 43 which holds the plate member 51 slidably.

The pair of contact parts 42 are formed so as to have a gently curved surface fitting to the shape of the top 21 of the upper cover 10 and have a pair of holes 44*a*, respectively, through which a common pin (not shown) is inserted to connect the pair of contact parts 42 to a pair of side supports 95 (FIGS. 15A-B) to be described later in greater detail. The pin inserted through the holes 44*a* is also inserted into corresponding holes (not shown) formed on the insides of the pair of sides 22 of the upper cover 10.

The slide parts 43 include a pair of upper holder portions 43*a* and a lower holder portion 43*b*. Like the pair of upper contact parts 42*a*, the pair of upper holder portions 43*a* each has a gently curved surface fitting to the top 21 of the upper cover 10. As shown, the lower holder portion 43*b* has a hole 45 in a center thereof which receives an upper part of the protrusion 64 when the protrusion 64 fits into the hole 36. The lower holder part 43*b* has an upward raise 64 at a right end thereof which selectively fits into one of a forward recess 56 and a backward recess 57 provided on the plate member 51 which will be described later in greater detail. The slide part 43 composed of the upper and lower holder portions 43*a* and 43*b* has a gap in which the plate part 52 of the plate member 51 is slidably held.

The plate member 51 is a member slidable between the pair of upper holder portions 43*a* and the lower holder portion 43*b* of the lock mechanism body 41. As shown in FIGS. 10A and 10B, the plate member 51 comprises a flat plate part 52, a pair of slider parts 53 each provided on a respective one of sides of the plate 52 and a different slider part 53 provided in the center of the back of the plate part 52, a pair of stops 54 each provided on an outer edge of a respective one of the pair of slider parts 53, and a handle 55 protruding upward from the plate part 52 and perpendicular to its moving direction.

The flat plate 52 is in contact with the upper cover 10 with an opening and has the externally visual section "LOCK" 58 thereon. The plate 52 moves while sliding on the underlying lower holder portion 43*b*. The pair of slider parts 53*a* slides contacting the pair of upper holder portions 43*a* of the lock mechanism body 41. Thus, each slider part 53 has a similar shape as the corresponding upper holder portion 43*a*.

The pair of stops 54 each are bent downward so as to protrude outward from a respective one of the pair of slider parts 53*a*, thereby abutting on a corresponding restricting inside 38*a* of the disengagement mechanism 30 to stop a forward operation of the disengagement mechanism 30, which will be described later in greater detail. As described above, the handle 55 protrudes upward through the opening 23 in the upper cover 10 so as to move the plate member 51 forward and backward.

Figure 10C:
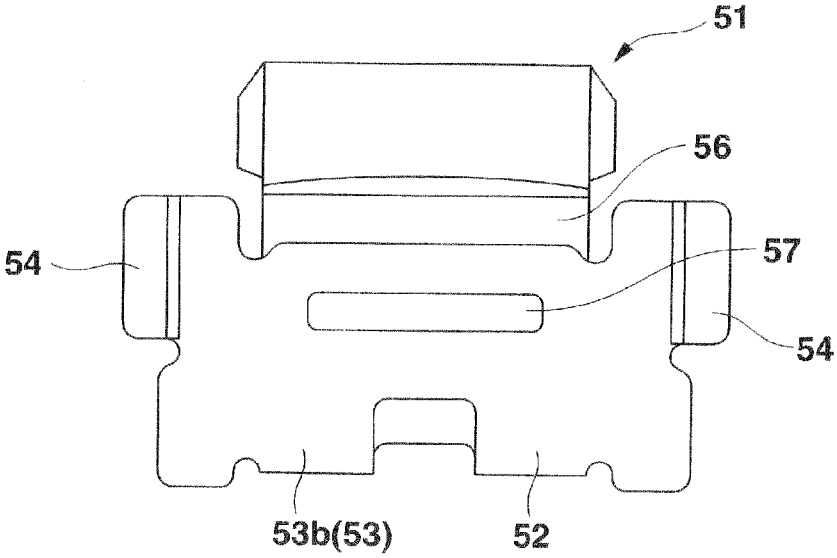

As shown in FIG. 10C and mentioned above, the plate member 52 has on the side of its back the forward and backward recesses 56 and 57. The forward recess 56 is delimited as an inside of the protruding knob 55 and the backward recess 57 is formed in a bent part of the plate part 52. As the plate member 51 is moved forward or backward, the protrusion 46 of the lock mechanism body 41 fits into the forward or backward recess 56 or 57. The central back part 53*b* slides on the lower holder portion 43*a*.

The buckle of this embodiment has a single body composed of the upper cover 10, lock mechanism 40 (including the lock mechanism body 41 and the plate member 51), and the disengagement mechanism 30 disposed in this order from above with the pair of operation members 37 of the disengagement mechanism 30 extending through the respective openings 24 provided on both the sides of the upper cover 10.

Then, unlocking and locking operations of the buckle 1 will be described next. In the unlocked state of the buckle 1, the protrusion 64 is disengaged from the hole 36 in the disengagement mechanism 30. In the locked state of the buckle 1, the protrusion 64 is fitted into the hole 36 in the disengagement mechanism 30. Thus, even when the pair of operation members 37 of the disengagement mechanism 30 are compressed toward each other, the protrusion 64 is disengaged from the hole 36.

Figure 11:
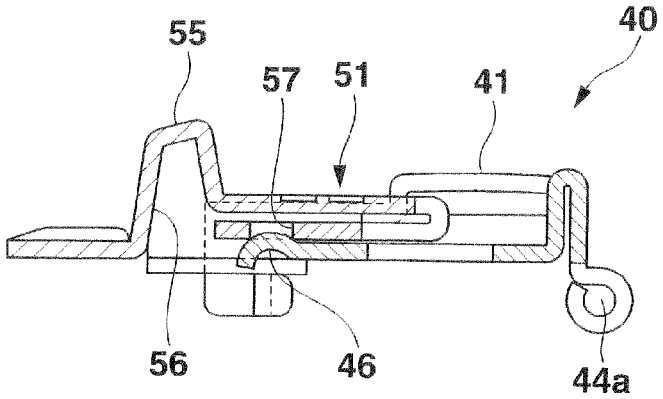
FIG. 11 is a cross-sectional view of the lock mechanism when unlocked.

FIG. 11 shows the unlocked state of the lock mechanism 40. In this state, the plate member 51 is held slidably between the upper and lower holder portions 43*a* and 43*b* of the lock mechanism body 41 and the raise 46 of the lock mechanism body 41 is fitted into the backward hole 57 in the plate member 51.

Figure 12:
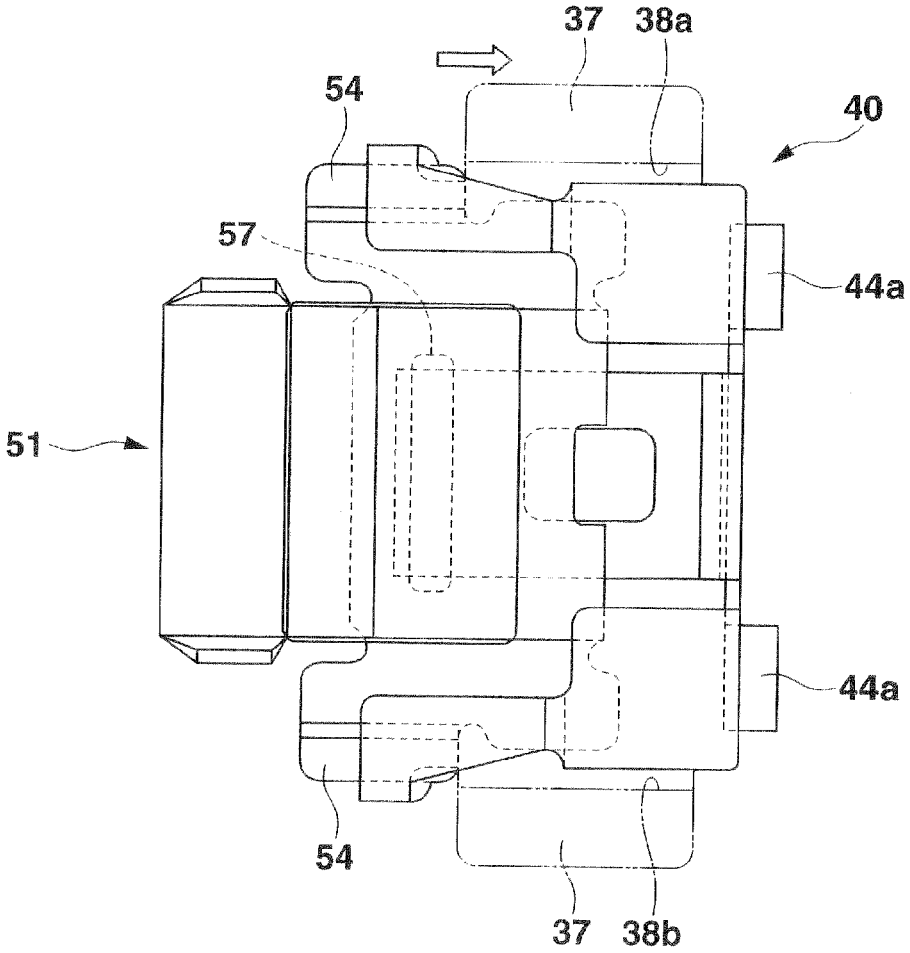
FIG. 12 is a plan view of the unlocked lock mechanism.

As shown in FIG. 12, in the unlocked state the pair of stops 54 of the plate member 51 are not engaged with the respective restricting insides 38 of the pair of operation members 37. Thus, the pair of operation members 37 can move forward without being hindered. More particularly, when the pair of operation members 37 are moved toward each other, thereby increasing the diameter of the hole 36 in the state where the protrusion 64 is fitted into the hole 36, the protrusion 64 is released from the hole 36. This causes the upper cover 10 to be disengaged from the lower engaging member 60, thereby putting the lock mechanism 40 in the unlocked state.

Although not shown, in the locked state the raise 46 of the lock mechanism body 41 is engaged in the forward recess 56 in the plate member 51, thereby maintaining the buckle 1 in the lock state. In this case, the pair of stops 54 of the plate member 51 abuts on the respective restricting insides 38*a* and 38*b* of the pair of operation members 37 because the plate member 51 is moved forward. That is, when the lock mechanism 40 is in the locked state, the pair of operation members 37 is prevented from moving forward. Thus, when the protrusion 64 is fitted into the hole 36, the pair of stops 54 are engaged with the respective restricting insides 38*a* and 38*b* of the pair of operation members 37. Therefore, the pair of operation members 37 can not move forward and hence enlarge the diameter of the hole 36. Thus, the protrusion 64 cannot be disengaged from the hole 36 and hence the upper cover 10 cannot be disengaged from the lower engaging member 60. That is, the lock mechanism 40 of the buckle 1 is put in the lock state.

As shown in FIGS. 8A and 8B, in the unlocked state of the lock mechanism 40 where the pair of stops 54 is moved backward, the visual section "LOCK" 58 is visible from outside. In the lock state where the pair of stops 54 are moved forward, the visual section 58 is brought under the upper cover 10 and not visible from outside. That is, the user is able to determine whether the buckle 1 is in the unlocked or locked state depending on whether the visual section is visible or not from outside.

Referring to FIGS. 13, 18A-19A, the band length adjustment mechanism 80 will be described which adjusts the overall band length with the folding band section 50 folded. The mechanism 80 comprises the upper cover 10, a folding-back shaft 82 disposed movable longitudinally within the upper cover 10, a length adjustment chain 81 connected at one end to a right end (FIG. 5) of the upper cover 10, folded back by the shaft 82 within the upper cover 10 and extending outward to connect to the band 172, and a shaft position adjuster 83 connected to the folding-back shaft 82 and engaged with the upper cover 10 to adjust the position of the shaft 82 in the length direction of the upper cover 10.

Figure 13:
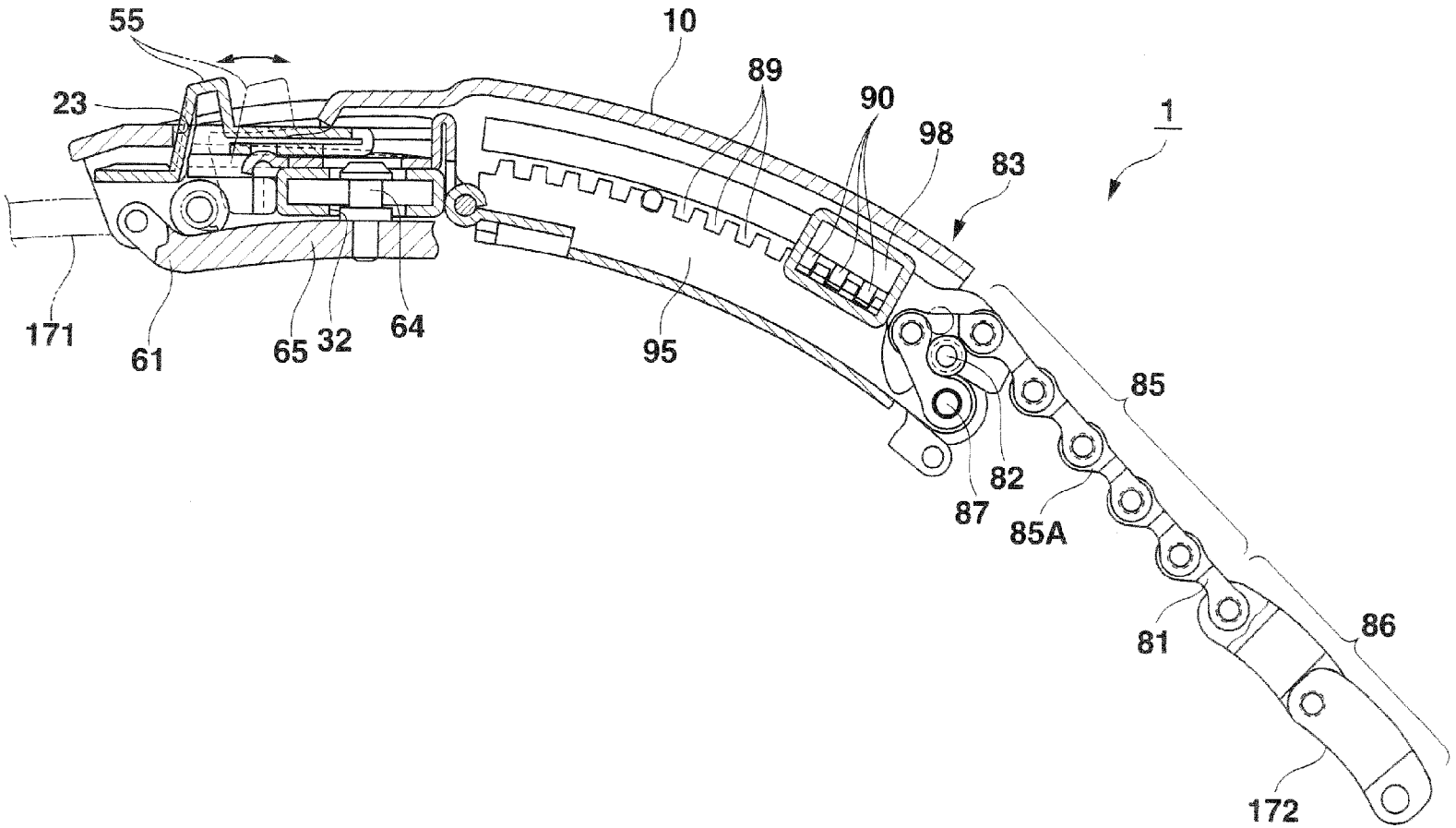
FIG. 13 is a side cross-sectional view of the buckle when folded, explaining a length adjustment mechanism.

As shown in FIGS. 13, 14, 19A and 19B, the length adjustment chain 81 is composed of a chain 85 folded by the shaft 82 within the upper cover 10 and a connection chain 86 which connects the chain 85 to the band 172. The chain 85 is pivoted at one end to the upper cover 10 by a two-part pin 87 whose parts are biased axially outward from each other by a spring (not shown) disposed therebetween. As shown in FIG. 13, each of components 85A of the chain 85 has an arc-shaped recess on its lower side so as to be folded in a small radius of curvature even in a small space within the upper cover 10. The chain 85 has a width W (FIG. 19A) selected so as to be accommodated within the upper cover 10.

Figure 16A:
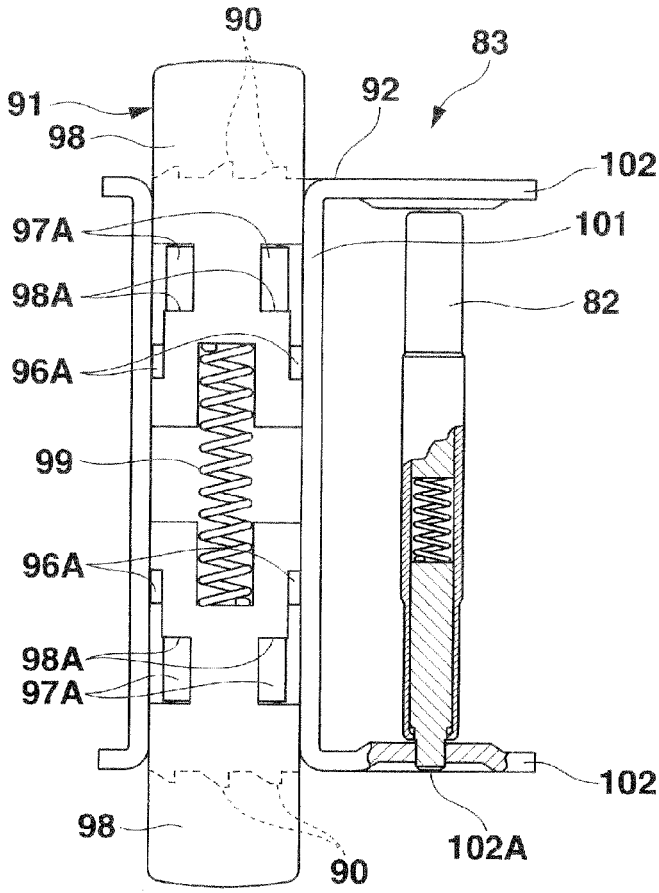
FIGS. 16A, 16B and 16C are a cross-sectional plan view and a cross-sectional side view and a side view, respectively, of a folding-back shaft position adjuster.
Figure 16B:
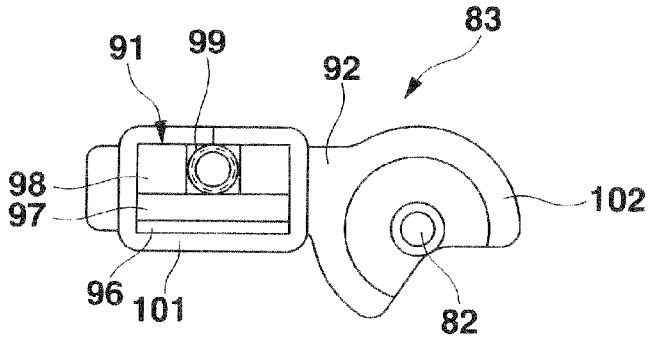
Figure 16C:
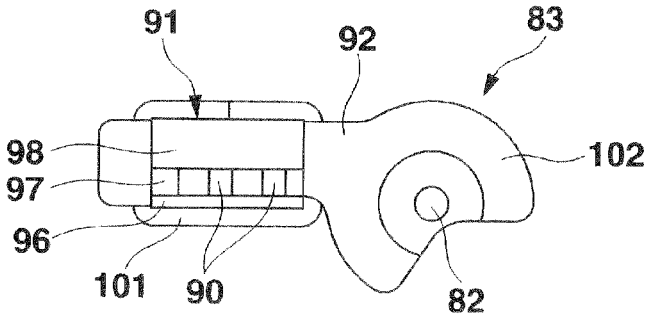
Figure 17:
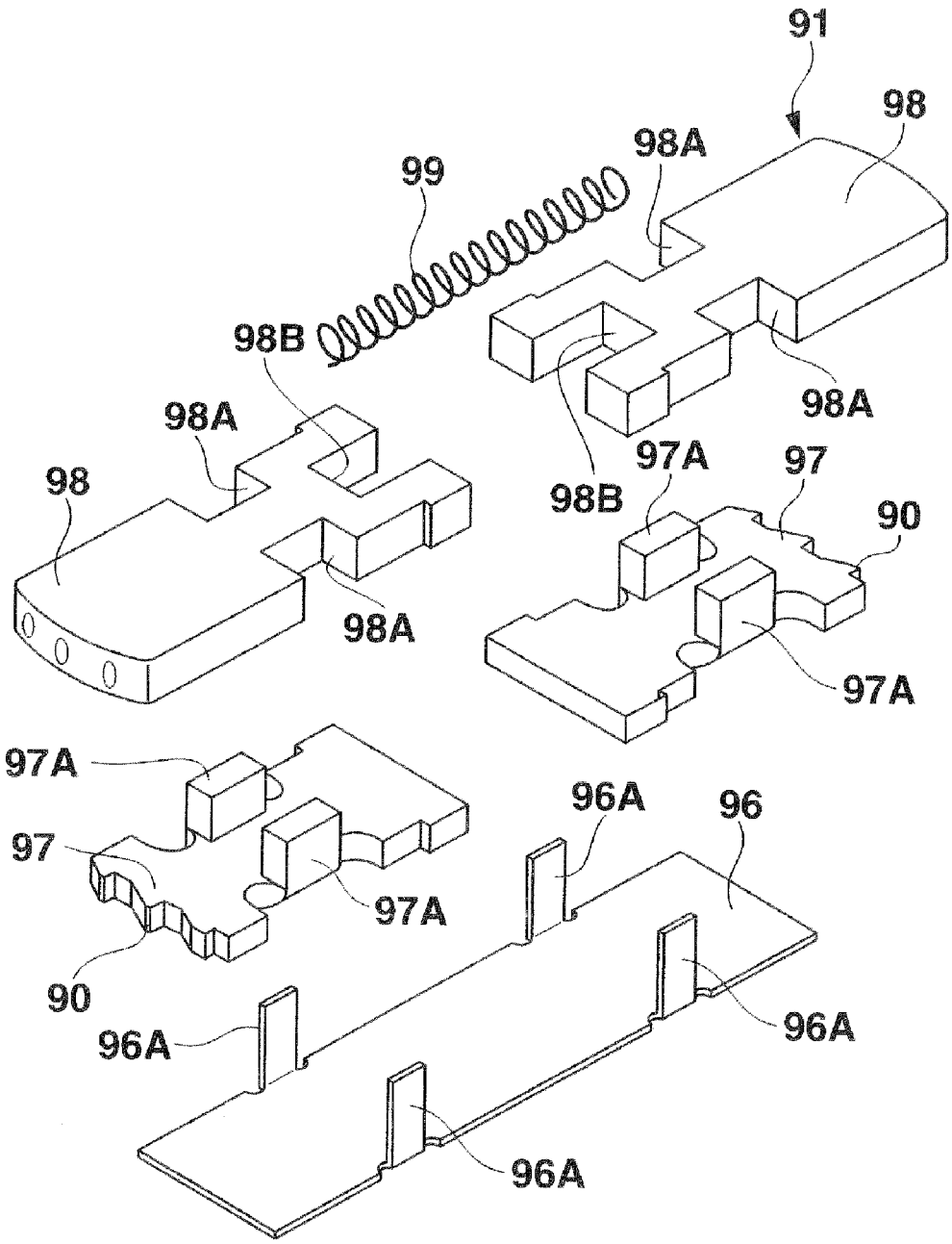
FIG. 17 is a perspective exploded view of a slider.

As shown in FIGS. 16A-16C, the folding-back shaft position adjuster 83 comprises a slider 91 with a pair of pawl rows 90 provided thereon so as to engage a pair of engaged notch rows 89 provided along the sides of the upper cover 10 and a slider link 92 which connects the slider 91 and the folding-back shaft 82.

Figure 15A:
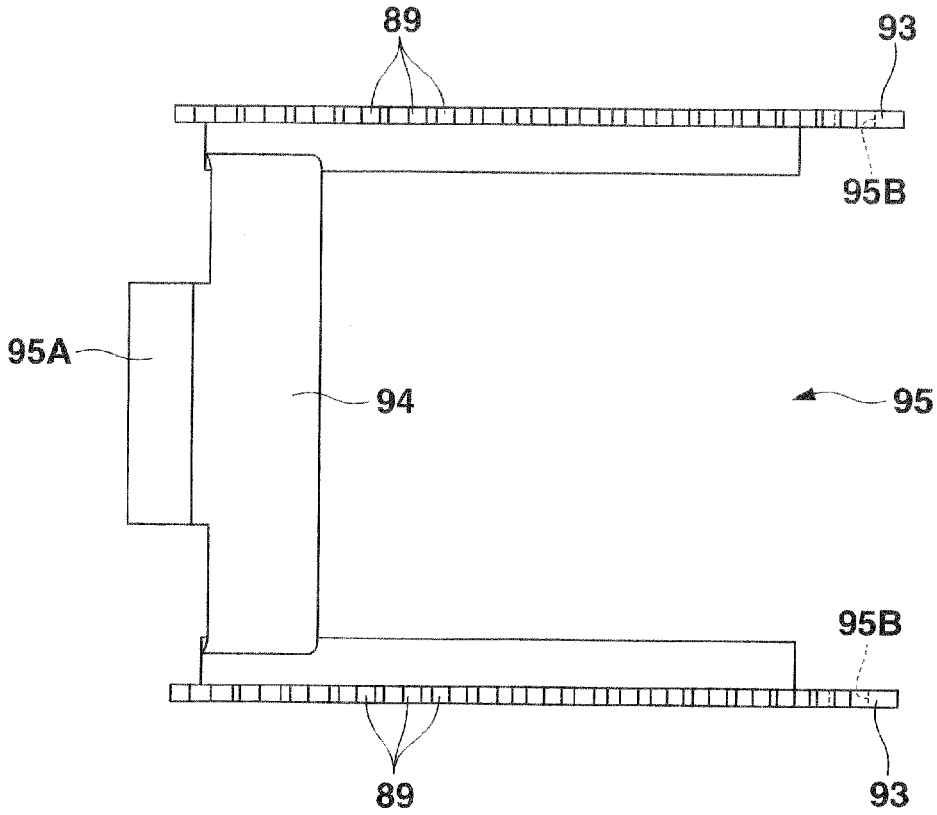
FIGS. 15A and 15B are a plan view and a side view, respectively, of a slider supporter.
Figure 15B:
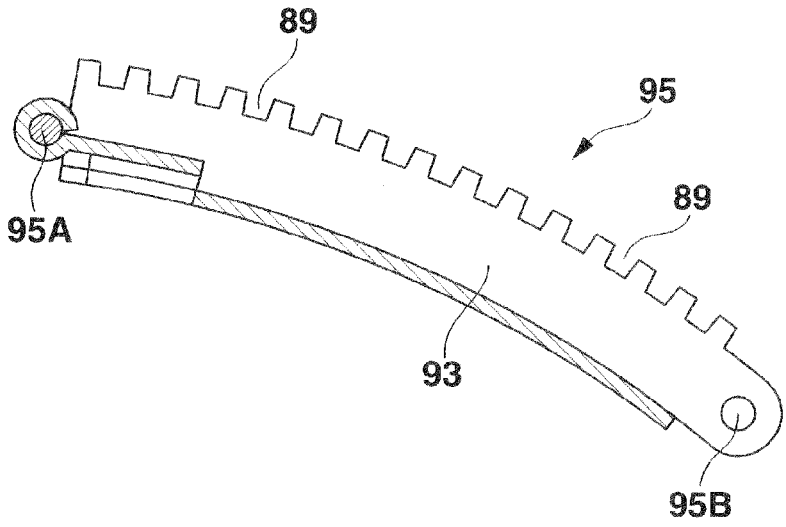

As shown in FIGS. 15A-15B, a slider supporter 95 is provided which comprises a pair of plate-like side supports 93 each with a respective one of the pair of engaged notch rows 89 and with each side support fastened to a respective one of the insides of the sides of the upper cover 10 and a bridge 94 connecting both the side supports 93. The slider supporter 95 has at a left end thereof a hole/pin pivot connection 95A to the lock mechanism body 41 (FIGS. 15A, 15B) and at a right end thereof a hole/pin pivot connection 95B-87 to the length adjustment chain 81 (FIGS. 13, 15B).

As shown in FIGS. 14, 16A-16C and 17, the slider 91 comprises a rectangular plate-like guide 96 with two pairs of upstanding support pieces 96A each provided along a respective one of both sides of the slider guide 96, a pair of plate-like pawl providers 97 each with a pawl row 90 provided on an outer end thereof with a pair of support protrusion 97A each on a respective one of both the sides of the pawl provider 97 and disposed on the guide 96 so as to be slidable by a predetermined distance along the length of the guide 96, a pair of slider buttons 98 each combined with a respective one of the slider pawl providers 97 such that the slider button 98 is supported by the pair of protrusions 97A of the related pawl provider 97 received in a pair of side cuts 98A each provided on a respective one of sides of the slider button 98 concerned, and a compression helical spring 99 provided between the pair of slider buttons 98 such that both ends of the spring 99 are received in corresponding cuts 98B provided on adjacent ends of the pawl providers 97 so as to push the pair of slider buttons 98 axially outward away from each other.

Figure 14:
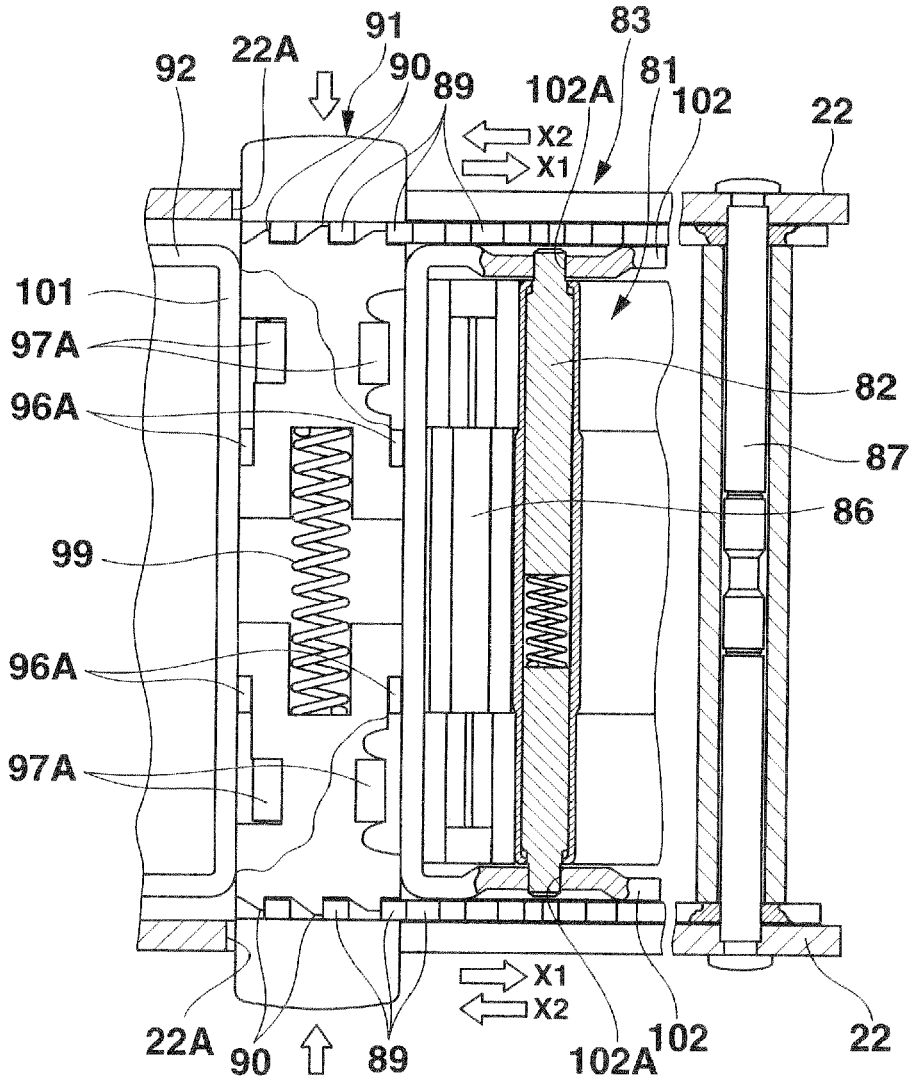
FIG. 14 is a cross-sectional plan view of the length adjustment mechanism.

In the slider 91, the pair of slider buttons 98 and the pair of pawl providers 97 are biased by the resiliency of the spring 99 away from each other. More particularly, when the spring 99 is extended, the pawl rows 90 of the pairs of pawl providers 97 are engaged with the respective notch rows 89 of the pair of side supports 93 whereas when the spring 99 is compressed, the pawl rows 90 of the pawl providers 97 are disengaged from the respective notch rows 89 of the side supporters 90. As shown in FIGS. 14 and 16A, when the slider 91 is received within the upper cover 10, the slider 91 extend outward through corresponding openings 22A provided in both the sides of the upper cover 10 so as to be pushable by the user.

As shown in FIGS. 14 and 16A, each pawl of the pawl row 90 of the pawl provider 97 has a side inclined at an obtuse angle to the tightening direction of the bands (or leftward in FIG. 16A) and a vertical side such that the slider 91 can move smoothly leftward relative to the frame, but cannot move in the opposite direction (or rightward in FIG. 16A) unless the pair of slider buttons 98 are compressed toward each other, thereby disengaging the slider 91 from both the side supports 93 because the respective pawls engage at their vertical sides with the corresponding notches of the pair of notch rows provided on the corresponding side supports 93.

As shown in FIGS. 14 and 16A-16B, the slider link 92 comprises a hollow rectangular cross-sectional cylinder 101 which receives the slider 91 and a pair of parallel plate-like sides 102 attached to the cylinder 101 so as to support the folding-back shaft 82 at its ends in holes 102A in the plate-like sides.

Operation of the band buckle 1 will be described next. When wearing the wristwatch 100, the user inserts his or her wrist into the ring-like band with the unfolded folding band section 50 (FIG. 4). Then, as shown in FIG. 2, then the folding band section 50 is folded back such that the pivoted intermediate and bottom plates 65 and 61 are folded back so as to be superposed on the upper cover 10. At this time, the engaging convexity 67 of the intermediate plate 67 fits into the recess 63 in the bottom plate 61, and the protrusion 64 of the bottom plate 61 fits into the hole 32 in the disengagement mechanism 30 received within the upper cover 10. Then, the disengagement mechanism 30 is locked by the lock mechanism 40.

When a total length of the buckle 1 and the bands 171 and 172 is not equal to the length of the outer periphery of the user's wrist, the user can compress the pair of slider buttons 98 of the slider 91 toward each other while moving the whole slider 91 along the length of the upper cover 10 (in the direction of X1 or X2 in FIGS. 14 and 18A), thereby changing the overall band length.

Figure 18A:
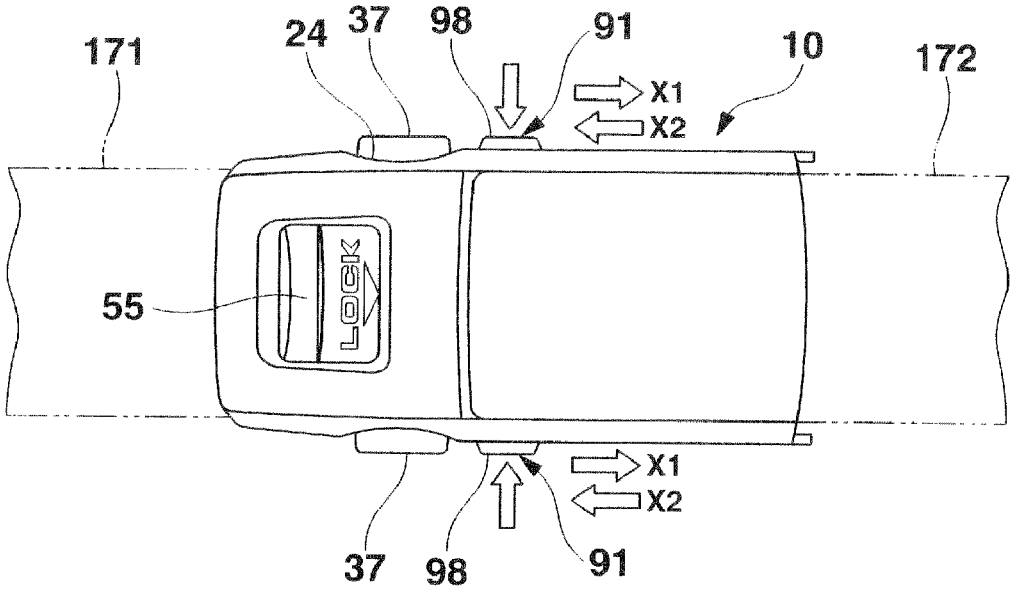
FIGS. 18A and 18B are a plan view and a side view, respectively, of the length adjuster before adjusted.
Figure 18B:
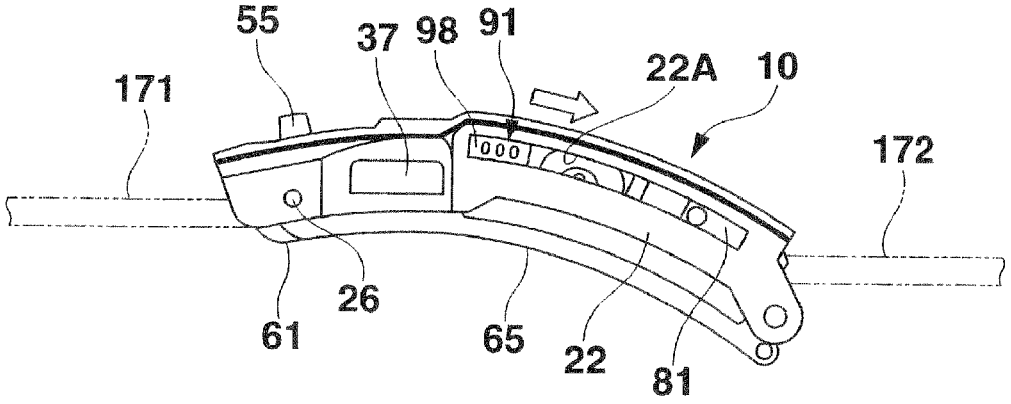
Figure 19A:
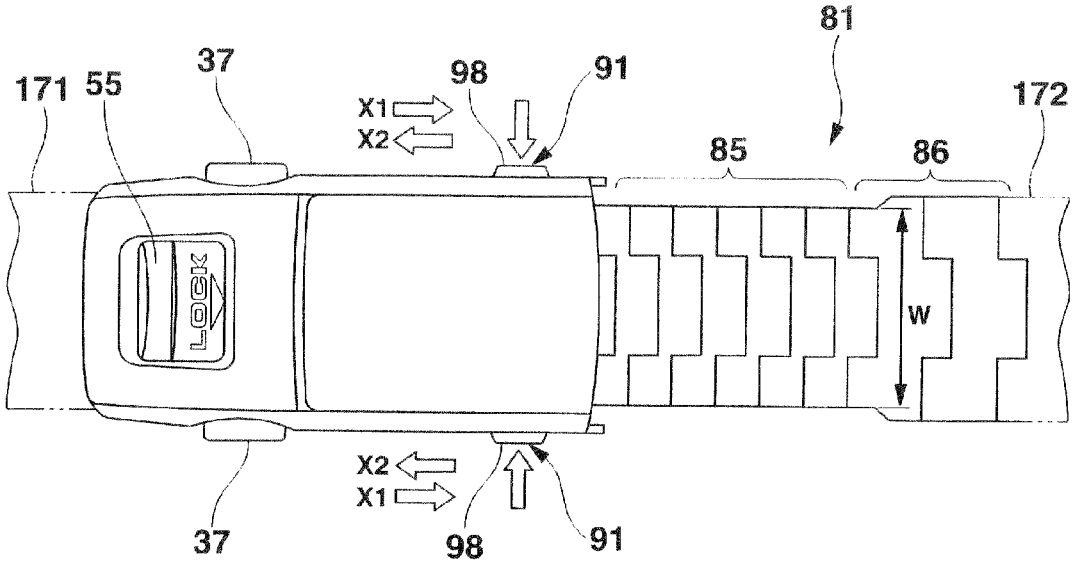
FIGS. 19A and 19B are a plan view and a side view, respectively, of the length adjuster after adjusted.
Figure 19B:
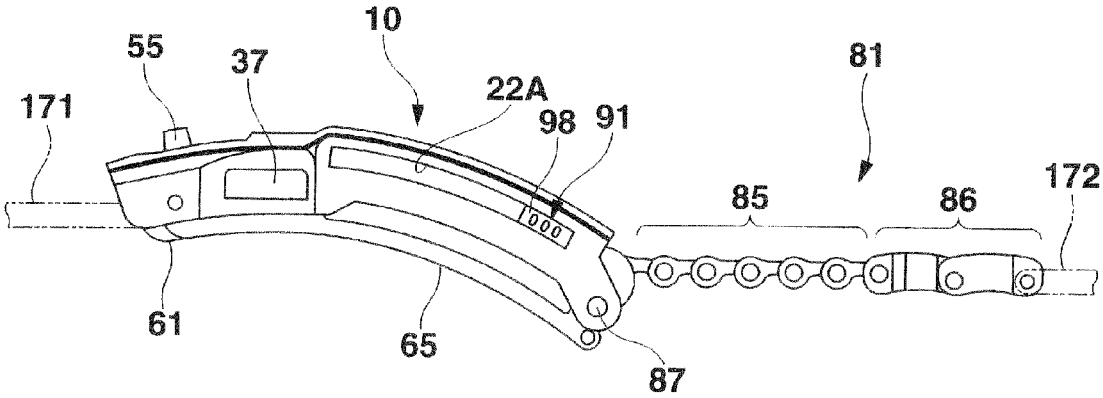

More particularly, as shown in FIGS. 14 and 18A, when the pair of slider buttons 98 are compressed toward each other, the pawl rows 90 of the pair of pawl providers 97 engaged resiliently with the notch rows 89 formed on the pair of side supports 90 by the compression spring 99 are disengaged from the notch rows 89. Then, when the whole slider 91 is moved by a desired distance in the length direction of the upper cover 10 (leftward or rightward in FIGS. 18A-18B) with the pair of slide buttons 98 compressed, and then the respective slider buttons 98 are released, the pair of slider buttons 98 and the pair of pawl providers 97 are moved away from each other by the resiliency of the spring 99. As a result, the pawl rows 90 of the pair of pawl providers 97 are again engaged with the respective notch rows 89 of the pair of side supports 98, thereby causing the slider 91 to be held on the pair of side supports 102 at a desired position in the extending direction of the band sections.

As just described above, when the slider 91 moves in one or the other direction along with the length of the upper cover 10, the slider link 92 is also moved along with the slider 91 in that direction. Thus, the folding-back shaft 82 supported by the slider links 92 is also moved in that direction. As a result, the position of the folding-back shaft 82 where the adjusting chain 81 is folded back changes, thereby changing the overall band length.

When the slider 91 is moved in the direction of an outline arrow X1 relative to the upper case 10 in FIG. 18A, the length of parts of the chain 81 folded back on each other is reduced, thereby increasing the overall band length and vice versa. This change in the overall band length is performed with the disengagement mechanism being locked by the lock mechanism 40. Since the position of the folding-back shaft 82 for the chain 81 is changed, an amount of adjustment of the overall band length is equal to the double of an amount of change in the movement of the folding-back shaft 82. Thus, only a short distance suffices for movement of the slider. As a result, advantageously, the adjustment is easy and the upper cover 10 is not required to be long.

As will be obvious from the above, according to the buckle of this embodiment, the folding-back shaft position adjuster is capable of moving the folding-back position of the band in the length direction of the frame. Thus, the length of the folded-back parts of the length adjusting chain superimposed on each other changes and as a result the overall band length change. When the position of the folding-back shaft where the band is folded back is moved away from the position where the chain is fixed at its end, the length of the folded parts of the chain increases and vice versa.

The folding-back shaft position adjuster preferably comprises the slider with the pair of pawl rows provided on the opposite ends of the slider engaging with the pair of notch rows provided on corresponding side supports attached to the frame, and the pair of links which link the slider and the folding-back shaft. When the slider is moved along the length of the frame, thereby changing the position where the pair of the pawl rows provided on the slider engage the pair of notch rows provided on the side supports, the position of the folding-back shaft in the length direction of the upper cover is changed through pair of slider links.

Preferably, the slider is biased by the spring so as to extend in opposite axial directions such that when the slider is released and extended, the pair of pawl rows provided on the opposite ends of the slider engage the pair of notch rows provided on the corresponding side supports and that when the slider is compressed, the pair of pawl rows are disengaged from the pair of notch rows provided on the corresponding side supports. If in this state the slider is moved to a desired position in the longitudinal direction of the frame and then released, the slider is extended, thereby causing the pair of pawl rows provided on the slider to engage the pair of notch rows provided on the corresponding side supports. The compression of the slider in its axial direction and the movement of the slider in the longitudinal direction of the frame can be easily performed by the user's one hand alone.

Each of the pawls of the pair of pawl rows provided on the opposite ends of the slider has a side inclined at an obtuse angle to the moving direction of the slider relative to the frame for tightening the band sections. Thus, the slider can move smoothly in that direction even if the slider is not compressed. Conversely, when the slider is moved in the opposite direction relative to the frame, the slider is required to be compressed toward each other such that the pair of pawl rows of the slider are disengaged from the pair of notch rows of the side supports. That is, when the overall band length is decreased, the slider can be moved smoothly whereas when the overall band length is increased, the slider is required to be compressed to disengage the pair of pawl rows of the slider from the pair of notch rows of the side supports.

The intermediate and bottom plates pivoted at one end are preferably provided between the end of the frame and one of the band sections so as to form the folding band section. This folding band section and the band length adjuster cooperate to increase a range of adjustment of the overall band length highly.

While, in the embodiment, the length adjuster 80 and the folding-back mechanism 50 are illustrated as combined, only the length adjuster member 80 may be combined with the buckle 1 for the band sections 171 and 172. While in the embodiment, application of the buckle 1 to the wristwatch band sections is illustrated, the present invention may be applied to other bands such as an ornamental wristband or a band which wears something on the user's body.

While in the embodiment the disengagement mechanism 30 and the lock mechanism 40 are illustrated as provided on the upper engaging member, they may be provided on the lower engaging member instead. While the lock mechanism 40 is illustrated as having the pair of stops 54 each on an outward edge of a respective one of the pair of slide parts 53*a* thereon, a pair of stops may be provided at corresponding appropriate positions where the lock mechanism 40 advances and then stops. While the pair of pawl rows and the pair of notch rows are illustrated as composing engaging means, any other known engaging means may be employed as such.

Various modifications and changes may be made thereto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. A buckle for a pair of band sections connected at one end to an object at a pair of opposite positions for wearing the object on a user's body, the buckle comprising:

a frame having a length connected at one end to one of the pair of band sections;

a length adjustment chain connected at one end to the other end of the frame and at the other end to the other end of the other band;

a chain folding-back shaft movable within the frame in its length direction for folding back the length adjustment chain within the frame in its length direction so as to extend outward from the other end of the frame; and a folding-back shaft position adjuster connected to the folding-back shaft so as to be movable within the frame in the length direction of the frame for adjusting the position of the folding-back shaft within the frame in the length direction of the frame.

2. The buckle of claim 1, wherein the folding-back shaft position adjuster comprises:

a slider movable in the length direction of the frame and having a pair of pawl rows engaging a pair of engaged element rows provided on corresponding opposite sides of the frame; and a slider link for linking the slider and the folding-back shaft together.

3. The buckle of claim 2, further comprising:

an elastic member for biasing the slider compressibly so as to extend the slider in opposite directions; and wherein:

when the slider is extended by a resiliency of the elastic member within the frame, the pair of pawl rows of the slider engage the pair of engaged element rows provided on the opposite sides of the frame; and when the slider is compressed against the resiliency of the elastic member, the pair of pawl rows of the slider are disengaged from the pair of engaged element rows provided on the opposite sides of the frame.

4. The buckle of claim 3, wherein:

each pawl of the pair of pawl rows has a side inclined at an obtuse angle to a moving direction of the slider relative to the frame for tightening the pair of band sections and a side vertical to the moving direction of the slider.

5. The buckle of claim 1, further comprising:

an intermediate plate and a bottom plate pivoted at one end to each other and at the other end to one end of the frame and the other end of one of the pair of band sections, the frame and the intermediate and bottom plates composing a folding band section.

6. A device to be worn on a user's body, comprising:

an object;

a pair of band sections connected at one end to the object at a pair of opposite positions for wearing the object on a user's body; and a buckle for connecting the other ends of the pair of bands, the buckle comprising:

a frame having a length connected at one end to one of the pair of band sections;

a length adjustment chain connected at one end to the other end of the frame and at the other end to the other end of the other band;

a chain folding-back shaft movable within the frame in its length direction for folding back the length adjustment chain within the frame in its length direction so as to extend outward from the other end of the frame; and a folding-back shaft position adjuster connected to the folding-back shaft so as to be movable within the frame in the length direction of the frame for adjusting the position of the folding-back shaft within the frame in the length direction of the frame.

7. The device of claim 6, wherein the folding-back shaft position adjuster comprises:

a slider movable in the length direction of the frame and having a pair of pawl rows engaging a pair of engaged element rows provided on corresponding opposite sides of the frame; and a slider link for linking the slider and the folding-back shaft together.

8. The device of claim 7, further comprising:

an elastic member for biasing the slider compressibly so as to extend the slider in opposite directions; and wherein:

when the slider is extended by a resiliency of the elastic member within the frame, the pair of pawl rows of the slider engage the pair of engaged element rows provided on the opposite sides of the frame; and when the slider is compressed against the resiliency of the elastic member, the pair of pawl rows of the slider are disengaged from the pair of engaged element rows provided on the opposite sides of the frame.

9. The device of claim 7, wherein:

each pawl of the pair of pawl rows has a side inclined at an obtuse angle to a moving direction of the slider relative to the frame for tightening the pair of band sections and a side vertical to the moving direction of the slider.

10. The device of claim 6, further comprising:

an intermediate plate and a bottom plate pivoted at one end to each other and at the other end to one end of the frame and the other end of one of the pair of band sections, the frame and the intermediate and bottom plates composing a folding band section.

* * * * *